US010263331B2

(12) United States Patent
Kundtz et al.

(10) Patent No.: US 10,263,331 B2
(45) Date of Patent: Apr. 16, 2019

(54) DEVICE, SYSTEM AND METHOD TO MITIGATE SIDE LOBES WITH AN ANTENNA ARRAY

(71) Applicants: Nathan Kundtz, Kirkland, WA (US); Bruce Rothaar, Woodinville, WA (US)

(72) Inventors: Nathan Kundtz, Kirkland, WA (US); Bruce Rothaar, Woodinville, WA (US)

(73) Assignee: KYMETA CORPORATION, Redmond, WA (US)

( * ) Notice: Subject to any disclaimer, the term of this patent is extended or adjusted under 35 U.S.C. 154(b) by 431 days.

(21) Appl. No.: 14/875,651

(22) Filed: Oct. 5, 2015

(65) Prior Publication Data

US 2016/0099500 A1 Apr. 7, 2016

Related U.S. Application Data

(60) Provisional application No. 62/060,370, filed on Oct. 6, 2014.

(51) Int. Cl.
*H01Q 3/30* (2006.01)
*H01Q 21/20* (2006.01)
(Continued)

(52) U.S. Cl.
CPC ..... *H01Q 3/30* (2013.01); *H01Q 21/005* (2013.01); *H01Q 21/0006* (2013.01); *H01Q 21/068* (2013.01); *H01Q 21/20* (2013.01)

(58) Field of Classification Search
CPC ..... H01Q 13/20; H01Q 13/24; H01Q 13/28; H01Q 21/068; H01Q 21/0037; H01Q 21/005
See application file for complete search history.

(56) References Cited

U.S. PATENT DOCUMENTS 3,560,975 A * 2/1971 Manuli ..... H01Q 3/28 342/356
4,052,723 A * 10/1977 Miller ..... H01Q 3/34 342/368
(Continued)

FOREIGN PATENT DOCUMENTS

EP 0159301 A1 10/1985
EP 0501224 A1 * 9/1992 ..... H01Q 21/005
(Continued)

OTHER PUBLICATIONS

International Preliminary Report on Patentability from PCT/US2015/054277 dated Apr. 20, 2017, 12 pgs.
(Continued)

*Primary Examiner* — Gregory C. Issing
(74) *Attorney, Agent, or Firm* — Womble Bond Dickinson (US) LLP

(57) ABSTRACT

Techniques and mechanisms to transmit signals with an antenna array. In an embodiment, a first signal is received at a first input of the first antenna while a second signal is received at a second input of the second antenna. A difference in phase differentials—the phase differentials each between the first signal and the second signal—results from propagation of the first signal and the second signal in the antenna array and from a difference between respective configurations of the first antenna and the second antenna. Each of the first antenna and the second antenna has respective emitters distributed along the length thereof. In another embodiment, the first antenna and the second antenna have different respective dielectric structures or different respective distributions of emitters.

14 Claims, 8 Drawing Sheets

(51) Int. Cl.
*H01Q 21/00* (2006.01)
*H01Q 21/06* (2006.01)

(56) References Cited

U.S. PATENT DOCUMENTS

| | | | | | |
|---|---|---|---|---|---|
| 4,188,633 | A * | 2/1980 | Frazita | H01Q 3/34 | 342/372 |
| 4,191,960 | A * | 3/1980 | Lopez | H01Q 3/34 | 342/372 |
| 4,475,107 | A | 10/1984 | Makimoto et al. | | |
| 5,032,805 | A * | 7/1991 | Elmer et al. | H01P 1/181 | 333/156 |
| 5,103,232 | A * | 4/1992 | Chang | H01Q 3/38 | 342/372 |
| 5,151,705 | A * | 9/1992 | Badger | H01Q 3/22 | 342/368 |
| 5,189,433 | A * | 2/1993 | Stern | H01Q 3/24 | 343/770 |
| 5,241,323 | A * | 8/1993 | Kelly | H01Q 21/20 | 343/700 R |
| 5,504,466 | A * | 4/1996 | Chan-Son-Lint | H01P 1/184 | 333/159 |
| 6,429,825 | B1 * | 8/2002 | Martek | H01Q 13/18 | 343/770 |
| 8,957,818 | B2 * | 2/2015 | Chen | H01Q 13/22 | 343/768 |
| 2004/0051667 | A1 | 3/2004 | Ro et al. | | |
| 2005/0012665 | A1 * | 1/2005 | Runyon | H01Q 1/246 | 342/372 |
| 2005/0134404 | A1 * | 6/2005 | Kajiya | H01P 1/181 | 333/156 |
| 2008/0211716 | A1 | 9/2008 | Haskell | | |
| 2008/0309568 | A1 | 12/2008 | Deng et al. | | |
| 2010/0225538 | A1 | 9/2010 | Zucker | | |
| 2014/0226453 | A1 | 8/2014 | Harel et al. | | |
| 2015/0084832 | A1 * | 3/2015 | Ai | H01Q 1/246 | 343/893 |

FOREIGN PATENT DOCUMENTS

| | | | | |
|---|---|---|---|---|
| GB | 0881748 | A | 11/1961 | |
| TW | I1261951 | | 4/2006 | |
| TW | 201411934 | A | 3/2014 | |
| WO | WO-2012126439 | | 9/2012 | |
| WO | WO-2012126439 | A2 * | 9/2012 | H01Q 1/246 |

OTHER PUBLICATIONS

Official Letter and Search Report from Taiwan (R.O.C.) Patent Application No. 104132872 dated Dec. 26, 2016, 3 pgs.
International Search Report and Written Opinion for PCT Patent Application No. PCT/US15/54277 dated Jan. 22, 2016, 15 pgs.
European Search Report and Search Opinion Received for EP Application No. 15849491.4, dated Apr. 25, 2018, 9 pages.

* cited by examiner

DEVICE, SYSTEM AND METHOD TO MITIGATE SIDE LOBES WITH AN ANTENNA ARRAY

RELATED APPLICATIONS

This application is a nonprovisional application based on U.S. Provisional Patent Application No. 62/060,370 filed Oct. 6, 2014, and claims the benefit of priority of that provisional application. Provisional Application No. 62/060,370 is hereby incorporated by reference.

BACKGROUND

1. Technical Field

Embodiments discussed herein generally relate to signal transmission devices. More particularly, certain embodiments include, but are not limited to, an antenna array configured to provide a signal phase difference.

2. Background Art

Various directional antenna systems, including flat panel antennae with limited apertures, exhibit a response outside a main beam, known as side lobes. During radio frequency (RF) reception, side lobes can cause unintended reception of adjacent satellite signals. During RF transmission, side lobes can cause unintended interference with other RF signals on adjacent satellites. The Federal Communications Commission (FCC) regulates the levels of these side lobes.

A width of the main beam and the size of side lobes are indicative of antenna performance characteristics. More particularly, a relatively narrow main beam and small side lobes correspond to better directional transmission characteristics. In the case of radio communications, good directional transmission enables more selective communication with a target device and/or better distinguishing by the target device of one transmitter from another nearby transmitter.

In a typical example of a conventional flat panel traveling-wave antenna array, multiple identical waveguides (channels), arranged in parallel with each other, variously transmit respective signals. Radiating elements of these waveguides generate identical sets of side lobes. As a result, the side lobes constructively interfere with one another (sum together), producing significant side lobe levels.

As the number and variety of devices in different environments continue to grow, the amount of wireless communication traffic in such environments will only increase over time. Accordingly, there is expected to be greater value placed on incremental improvements in the suppression of side lobe signal components for directional antenna transmissions.

BRIEF DESCRIPTION OF THE DRAWINGS

The various embodiments of the present invention are illustrated by way of example, and not by way of limitation, in the figures of the accompanying drawings and in which.

DETAILED DESCRIPTION

Figure 1:
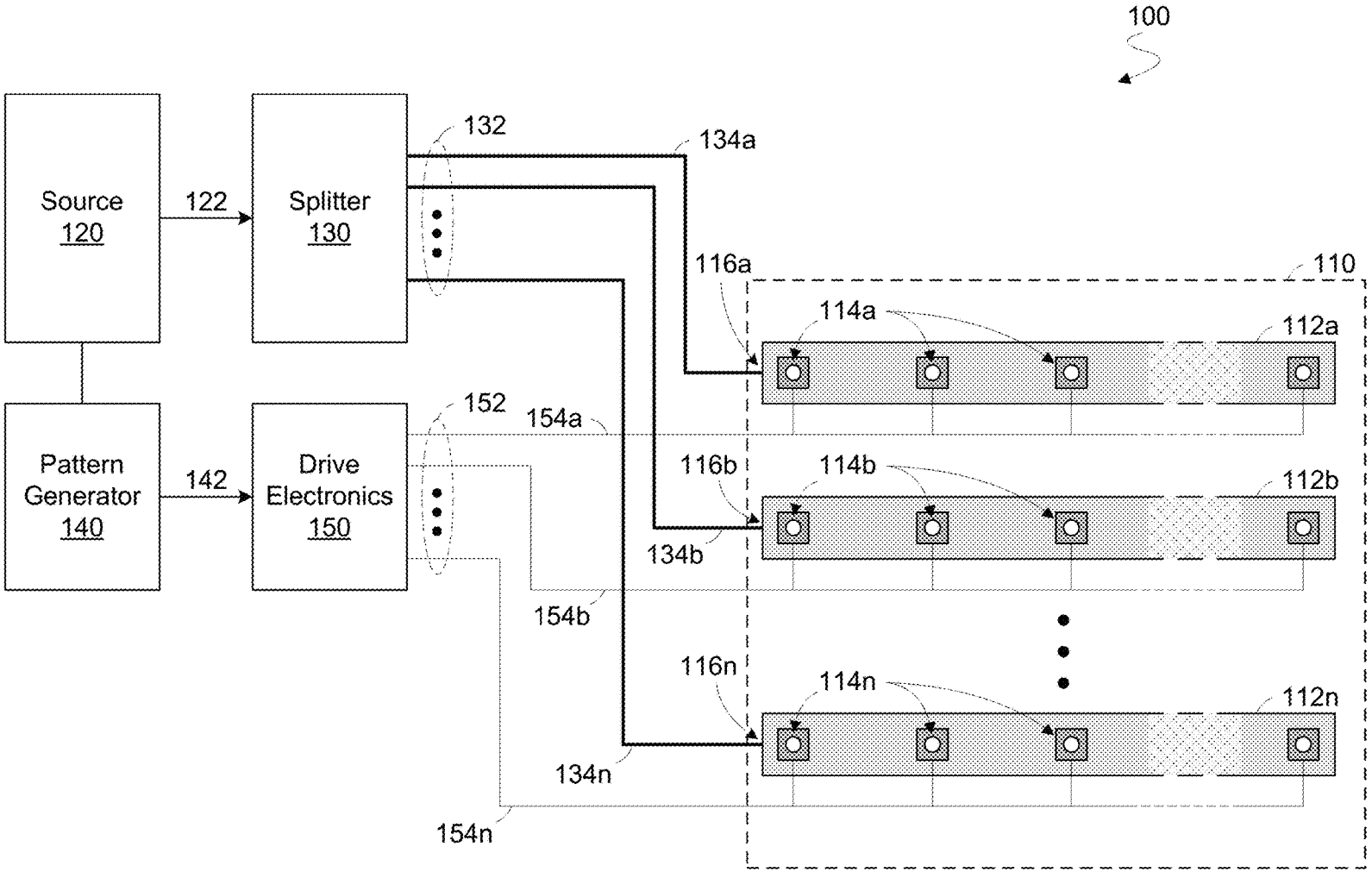
FIG. 1 is a functional block diagram illustrating elements of a system to transmit a signal according to an embodiment.

Embodiments described herein variously provide techniques and/or mechanisms to transmit signals with an antenna array. In an embodiment, an antenna array includes a first antenna and a second antenna, where a first signal is provided at a first input of the first antenna while a second signal is provided at a second input of the second antenna. Signal emission from the first antenna and the second antenna may be characterized by a phase differential other than a phase differential corresponding to the first input and the second input. For example, as the first signal and the second signal variously propagate away from the first input and the second input, respectively, the first antenna and the second antenna may passively induce a change in a phase differential between the first signal and the second signal. As a result, side lobe characteristics may be mitigated for electromagnetic (EM) emissions from the array. For example, a phase difference between respective portions of the first signal and the second signal may be emitted from the first antenna and second antenna respectively, wherein a passively-induced phase difference between these portions facilitates destructive interference of the first signal and the second signal with each other and/or with other signals that might be concurrently transmitted with the antenna array.

Embodiments described herein variously provide for multiple antennae (channels) of an antenna array to each emit the same main beam energy, so that respective main beams of the channels sum across the array. However, some or all such channels may each emit a slightly different side lobe pattern. This difference between side lobe patterns may be achieved at least in part by different respective physical characteristics of various antennae—e.g., where such different characteristics induce one or more signal phase changes.

Differences in the physical characteristics of antennae may include, for example, different physical positions of emitters along channel waveguides of the array. In some embodiments, emitters of antennae are at different distances from the respective inputs of said antennae. As a result of such differences in emitter positions, a phase at a given resonator (emitter) of one antenna may be slightly different than a signal phase at a corresponding resonator of another antenna.

Alternatively or in addition, differences in physical characteristics of antennae may include different respective lengths of a propagation media (e.g., a dielectric material), and/or may include lengths of propagation media having different dielectric properties. For example, a delay of a signal—and a corresponding phase shift of that signal—may be provided by a change in dielectric material along the length of an antenna. In an embodiment, an antenna includes multiple sections of different propagation media to induce successive wave propagation rate changes along the length of the antenna.

In one embodiment, phase differentials between antennae of an array may avoid modes or other constructive interference patterns by the array. For example, the array may provide a set of phase differences each between a respective pair of antennae. The set of phase differences may be chosen to avoid any two phase differences being integer multiples of one another. By way of illustration and not limitation, a distribution of phase differentials may be according to a distribution analogous to the "Circle of Fifths" for musical tones.

The Circle of Fifths provides an audio frequency corollary to phase differentiation according to one embodiment, wherein a middle C note is at 256 Hz, and the G note above middle C is 1.5 times that frequency. Each successive tone in the Circle of Fifths (C, G, D, A, E, B, F#, C#, G#, D#, A#, F) is 1.5 times that of the preceding tone. In an analogous application to difference values for phase differentials according to an embodiment, values may be variously divided—e.g., by 2, one or more several times as necessary—to facilitate placement of a set of corresponding difference values each in a 0° to 360° (0 to 2π radian) range.

Certain features of various embodiments are discussed herein with respect to an antenna array that is to operate as a transmitter, where antennas of the array are each provided with a respective signal that propagates along a length of that array. The antenna array may induce a difference between phase differentials each for a given pair of signals to be variously transmitted from the array. However, in some embodiments, an antenna array may additionally or alternatively act as a receiver, where antennas of the array each receive a respective signal that has been transmitted from a remote device. In such an embodiment, the antenna array may induce a difference between phase differentials each of a given pair of the signals that are received from the remote device.

Certain features of various embodiments are discussed herein with respect to an antenna array that induces a difference between phase differentials each for a given pair of signals that are to be transmitted from (or alternatively, have been received by) the antenna array. However, in some embodiments, a difference in phase differentials may be additionally or alternatively induced at circuitry that is coupled to the antenna array. By way of illustration and not limitation, transmitted circuitry and/or receiver circuitry may be coupled to such an antenna array, the circuitry to exchange different signals each with a respective antenna of the antenna array. The circuitry may selectively delay or otherwise offset a phase of one or more such signals to provide for a difference between phase differentials each for a given pair of signals. Such a phase offset may be distinguishable from phase modulation schemes, for example, at least insofar as the phase offset may be a static, unchanging offset applied throughout a communication exchange. The phase differentials may aid in mitigating side lobes of a signal to be transmitted by the array and/or mitigate the effects of side lobes in a signal that has been received by the array.

In the following description numerous specific details are set forth to provide a thorough understanding of the embodiments. One skilled in the relevant art will recognize, however, that the techniques described herein may be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

FIG. 1 illustrates elements of a system 100 to transmit a signal with an antenna array according to an embodiment. System 100 may include any of a variety of radio, radar and/or other transmission devices. System 100 is one example of an embodiment wherein a signal is variously split into a plurality of component signals including a first signal and a second signal, where a first antenna of an antenna array is configured to be provided with the first signal concurrent with a second antenna of the antenna array being provided with the second signal. In an embodiment, propagation of the first signal in the first antenna, and propagation of the second signal in the second antenna, results in different phase differentials each between the first signal and the second signal.

In the illustrative embodiment shown, system 100 includes an antenna array 110 comprising a plurality of antennae—e.g., such as the illustrative antennae 112*a*, 112*b*, . . . , 112*n*. The particular number of antennae 112*a*, 112*b*, . . . , 112*n*, and their particular configuration with respect to one another, is merely illustrative, and not limiting on some embodiments. Antennae 112*a*, 112*b*, . . . , 112*n* may be configured each to transmit a respective one or more signals provided, for example, by a splitter 130. In an embodiment, system 100 includes a source 120—e.g., a radio signal source or a radar signal source—coupled to provide to splitter 130 a signal 122 that, for example, represents information to be communicated from system 100 via antenna array 110 to a remote device (not shown). Based on signal 122, splitter 130 may generate a set 132 of signals to be variously transmitted each with a different respective antenna of antenna array 110. By way of illustration and not limitation, generation of set 132 may include variously splitting power of signal 122, and outputting portions of such power each as a respective one of signals 134*a*, 134*b*, . . . , 134*n*.

Antenna array 110 is an example of an antenna array configured to mitigate side lobes according to an embodiment. Antennae 112*a*, 112*b*, . . . , 112*n* may each include a respective waveguide structure and a propagation media (not shown) disposed therein. In the example embodiment shown, respective inputs 116*a*, 116*b*, . . . , 116*n* of antennae 112*a*, 112*b*, . . . , 112*n* are each coupled to be provided from splitter 130 a respective one of signals 134*a*, 134*b*, . . . , 134*n*. Subsequently, signals 134*a*, 134*b*, . . . , 134*n* variously propagate away from inputs 116*a*, 116*b*, . . . , 116*n* each along the length of a respective one of antennae 112*a*, 112*b*, . . . , 112*n*.

Antennae 112*a*, 112*b*, . . . , 112*n* may include emitters variously configured to emit portions of signals 134*a*, 134*b*, . . . , 134*n* for transmission. By way of illustration and not limitation, emitters 114*a* may be variously disposed along a length of antenna 112*a*, where different portions of signal 134*a* are to variously propagate to, and through, respective ones of emitters 114*a*. Emitters 114*a* may provide openings, apertures or other such structures to allow a signal pass-through at a sidewall in the waveguide of antenna 112*a* (where the signal propagates between sidewalls of the waveguide toward a far end of the waveguide). Similarly, emitters 114*b* may be additionally or alternatively disposed along antenna 112*b* to variously emit portions of signal 134*b*, and/or emitters 114*c* disposed along antenna 112*c* may be variously configured to emit portions of signal 134*c*.

Although certain embodiments are not limited in this regard, some or all of emitters 114*a*, 114*b*, . . . , 114*n* may be variously controllable to shape the form of a beam generated with antenna array 110. For example, system 100 may further comprise a pattern generator 140 including logic (e.g., circuitry and/or software) configured to determine a transmission pattern to be provide with antenna array 110. The pattern may be described by or otherwise communicated to drive electronics 150 based on pattern information 142 from pattern generator 140.

Based on pattern information 142, drive electronics 150 may generate a set 152 of control signals to regulate signal emission from antenna array 110. By way of illustration and not limitation, set 152 may include control signals 154*a*, 154*b*, . . . , 154*n* to be received, respectively, at antennae 112*a*, 112*b*, . . . , 112*n*. In response to control signals 154*a*, 154*b*, . . . , 154*n*, antennae 112*a*, 112*b*, . . . , 112*n* may selectively open and/or close various respective ones of emitters 114*a*, 114*b*, . . . , 114*n*. Such selectively control of emitters 114*a*, 114*b*, . . . , 114*n* may enable shaping of a waveform—e.g., where such shaping is performed in concert with signal power allocation by splitting 130.

Certain embodiments variously provide for a difference between two phase differentials, where such difference is a result of signal propagating in antenna having different respective configurations. As used herein, "phase differential" refers to a difference, at a particular time, between the respective phases of two signals each propagating in a different respective antenna of an antenna array. A phase of a signal may depend on a location in the antenna—e.g., where, at a particular time under consideration, the signal in question has a first phase value at a particular location along a length of a given antenna.

In an embodiment, propagation of two signals in different respective antennae, in combination with different respective configurations of such antennae, results in a difference between phase differentials for different locations of the antennae. By way of illustration and not limitation, at some time t1, signal 134*a* may have a phase $\varphi 11$ at input 116*a*, while signal 134*b* may have a concurrent phase $\varphi 12$ at input 116*b*. A phase differential, corresponding to time t1, between inputs 116*a*, 116*b* may thus be $\Delta\varphi 1=(\varphi 12-\varphi 11)$. Between time t1 and a later time t2, signal 134*a* may propagate away from input 116*a* and toward one of emitters 114*a*, where signal 134*b* concurrently propagates away from input 116*b* and toward one of emitters 114*b*. At time t2, signal 134*a* may have a phase $\varphi 21$ at a location other than input 116*a*—e.g., where signal 134*b* has a phase $\varphi 22$ a location other than input 116*b*. Thus, a corresponding phase differential, for time t2, between such locations of antennae 112*a*, 112*b*, may be $\Delta\varphi 2=(\varphi 22-\varphi 21)$. Although certain embodiments are not limited in this regard, either of $\Delta\varphi 2$ and $\Delta\varphi 1$ may be zero, a negative value or a positive value.

In an embodiment, $\varphi 21$ corresponds to a particular one of emitters 114*a* and/or to a particular distance from input 116*a*. Additionally or alternatively, $\varphi 22$ may correspond to a particular one of emitters 114*b* and/or to a particular distance from input 116*b*. For example, $\varphi 21$ may correspond to an emitter that is the Nth closest one of emitters 114*a* to input 116*a* (where N is a positive integer), and $\varphi 22$ may correspond to an emitter that is the Nth closest one of emitters 114*b* to input 116*b*. In such a scenario, a difference between $\Delta\varphi 2$ and $\Delta\varphi 1$ may be based at least in part on a difference between a configuration of antenna 112*a* and a configuration of antenna 112*b*. Such a difference between $\Delta\varphi 2$ and $\Delta\varphi 1$ may be independent, for example, of any changing phase of signal 134*a* over time and/or independent of any changing phase of signal 134*b* over time. For example, the difference between $\Delta\varphi 2$ and $\Delta\varphi 1$ attributable to the different configurations of antennae 112*a*, 112*b* may be in addition to, but distinguishable from, any other change in phase difference that might be the result of phase modulation of signal 134*a* and/or signal 134*b*.

By way of illustration and not limitation, a difference $(\Delta\varphi 2-\Delta\varphi 1)$ may result at least in part from emitters 114*a* having a distribution along antenna 112*a* that is different than a distribution of emitters 114*b* having along antenna 112*b*. For example, a total number of emitters 114*a* may be different than a total number of emitters 114*b*. Additionally or alternatively, antennae 112*a*, 112*b* may have different respective overall lengths and/or a distance of input 116*a* from an Nth one of emitters 114*a* may be different than a distance of input 116*b* from an Nth one of emitters 114*b*. In some embodiments, an arrangement of one or more propagation materials in antenna 112*a* is different than an arrangement of one or more propagation materials in antenna 112*b*.

Antenna array 110 may include any of a variety of combinations of fewer, more and/or different antennae, according to different embodiments. Additionally or alternatively, certain embodiment may vary with respect to the number of emitters on any one antenna of array 110, and/or the positions of emitters on various antennae.

Figure 2:
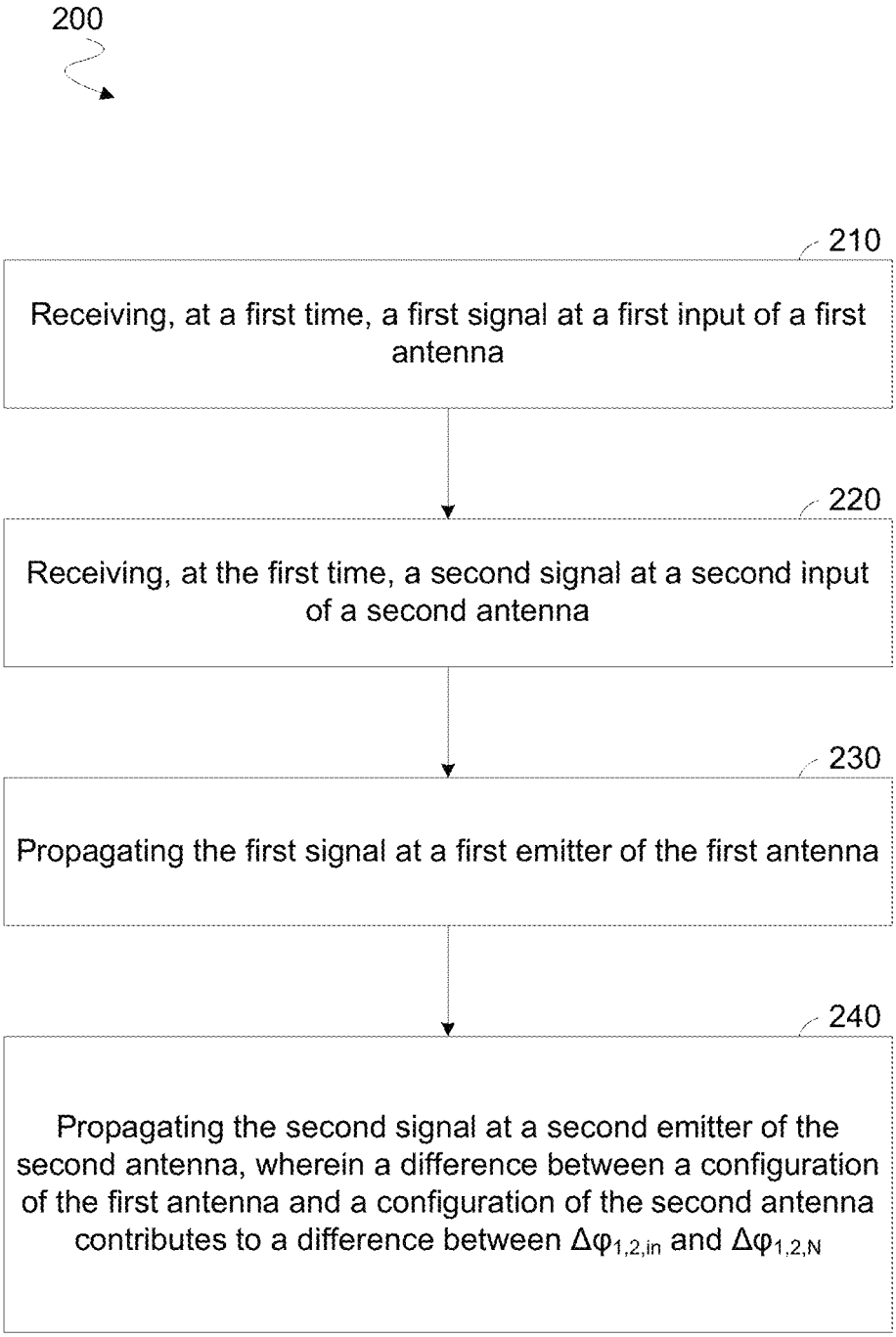
FIG. 2 is a flow diagram illustrating elements of a method for operating an antenna array according to an embodiment.

FIG. 2 shows elements of a method 200 to operate an antenna array according to an embodiment. Method 200 may provide for operation of antenna array 110 and/or other components of system 100, for example. Antennae of the array may each include a respective waveguide structure and one or more propagation media disposed therein. Such antennae may each further comprise respective emitters variously formed in or on the waveguide structure. Although certain embodiments are not limited in this regard, some or all such emitters may be operable to selectively open or close in response to control signaling.

In an embodiment, method 200 includes, at 210, receiving, at a first time, a first signal at a first input of a first antenna. Method 200 may further comprise, at 220, receiving, at the first time, a second signal at a second input of a second antenna. By way of illustration and not limitation, the receiving at 210 may include input 116*a* receiving signal 134*a*, where the receiving at 220 includes input 116*b* receiving signal 134*b*.

At 230, method 200 may include propagating the first signal at a first emitter of the first antenna. A portion of the signal may propagate through the first emitter, although certain embodiments are not limited in this regard. Of all emitters of the first antenna, the first emitter may be an Nth closest emitter to the first input, wherein N is a positive integer. For example, the first emitter may be the Nth emitter in a sequence of a first plurality of emitters from along a path extending from the first input along a length of the first antenna—e.g., where the first signal is to propagate along said path.

Method 200 may further comprises, at 240, propagating the second signal at a second emitter of the second antenna—e.g., wherein, of all emitters of the second antenna, the second emitter is an Nth closest emitter to the second input. In an embodiment, a difference between a configuration of the first antenna and a configuration of the second antenna contributes to a difference between a first phase differential, at the first time, between the first signal at the first input and the second signal at the second input and a second phase differential, at a second time, between the first signal at the first emitter and the second signal at the second emitter.

For example, the difference between the first phase differential and the second phase differential may be based at least in part on a first difference between a distance of the first emitter from the first input, and a distance of the second emitter from the second input. By way of illustration and not limitation, the first difference may be equal to or greater than a width of the first emitter (or alternatively, greater than a width of the second emitter). In an embodiment, the first distance may be at least three (3) times—e.g., five (5) times or more than—the width of an emitter.

Additionally or alternatively, the difference between the first phase differential and the second phase differential may be based at least in part on different arrangements of respective propagation media of the first antenna and the second antenna having different configurations of respective propagation media. For example, the first antenna may comprise a first medium disposed between the first input and the first emitter, where the second antenna comprises a second medium disposed between the second input and the second emitter. The first signal may propagate from the first input to the first emitter via the first medium, and the second signal may propagate from the second input to the second emitter via the second medium. In such an embodiment, the difference between the first phase differential and the second phase differential may be based at least in part on a difference between a permittivity of the first medium and a permittivity of the second medium.

Additionally or alternatively, a configuration of the first medium in the first antenna—e.g., including an extent of the first medium along the length of the first antenna—may be different than configuration of the first medium in the first antenna. By way of illustration and not limitation, the first medium may adjoin the first input and further adjoin the first emitter, wherein the second medium adjoins only one of (or neither of) the second input and the second emitter. Alternatively, the first medium may adjoin neither the first input nor the first emitter, where the second medium adjoins neither the second input nor the second emitter, but where a length of the first medium along the first antenna is different than a length of the second media along the second antenna.

Such embodiments are merely some examples of how a difference between respective characteristics, intrinsic to antennae, may give rise to a change in phase differential as respective signals propagate through such antennae. Such changes in phase differential may be said to be passively induced, at least insofar as they are not the result of phase changes due to circuitry that is coupled to, and drives transmission by, the antenna array.

Figure 3:
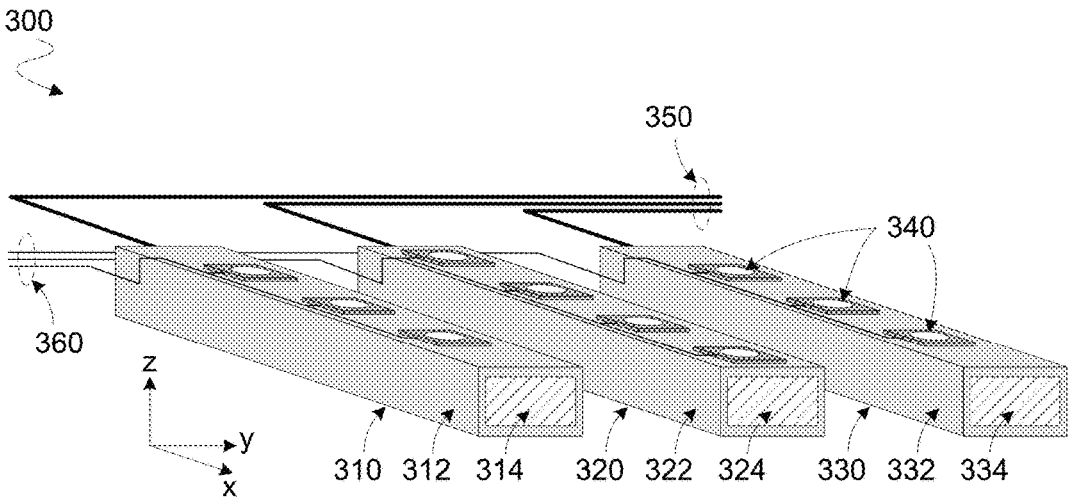
FIG. 3 shows a perspective view and a top view of an antenna array to transmit a signal according to an embodiment.
Figure 3:
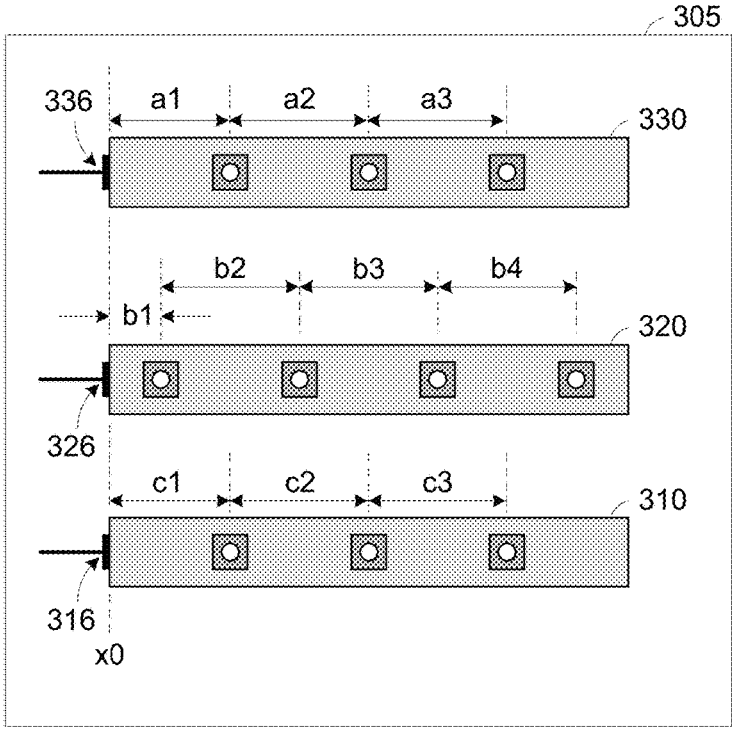

FIG. 3 illustrates elements of an antenna array 300 to transmit signals according to an embodiment. Antenna array 300 may include some or all features of antenna array 110, for example. In an embodiment, operation of antenna array 300 is performed according to method 200.

In the embodiment shown, antenna array 300 includes a plurality of antennae each including a respective waveguide structure and a propagation medium disposed therein. By way of illustration and not limitation, array 300 may include antennae 310, 320, 330 comprising respective waveguide structures 312, 322, 332 and respective dielectric structures 314, 324, 334 variously disposed therein. Although certain embodiments are not limited in this regard, waveguide structures 312, 322, 332 may each be straight and arranged in parallel with each other.

Signals 350 may be variously provided to antennae 310, 320, 330—e.g., from power splitter circuitry (not shown) coupled thereto. Antennae 310, 320, 330 may further comprise respective emitters 340 variously distributed each on a respective one of waveguide structures 312, 322, 332. Control signals 360 may be further coupled, in some embodiments, to selectively determine how signal power is to be variously output from different ones of emitters 340.

Antenna array 300 is one example of an array, according to an embodiment, including two antennae to concurrently be provided with different respective signals for transmission, where a difference between respective physical characteristics of the antennae results in a difference between phase differentials (each phase differential between the two signals). The top view 305 of antenna array 300 shows one example of various physical differences—between different pairs of antennae 310, 320, 330—that variously facilitate differences in phase differentials for different pairs of signals 350.

As shown in 305, respective inputs 316, 326, 336 of 310, 320, 330 may be coupled each to receive a different respective one of signals 350. Two or more of antennae 310, 320, 330 may vary from one another at least with respect to a total numbers of emitters and/or a distribution of emitters. By way of illustration and not limitation, respective inputs 316, 326, 336 of antennae 310, 320, 330 may each be coupled to receive a respective one of signals 350. Inputs 316, 326, 336 may be aligned with each other, for example, along a line x0. In such an embodiment, an emitter of antenna 310 that is closest to input 316 may be offset from input 316 by a distance c1, where two other emitters of antenna 310 are variously offset by distances c2, c3. Additionally or alternatively, an emitter of antenna 320 that is closest to input 326 may be offset from input 326 by a distance b1 (e.g., different than c1), where three other emitters of antenna 320 are variously offset by distances b2, b3, b4. In some embodiments, an emitter of antenna 330 that is closest to input 336 may be offset from input 336 by a distance a1 (which may be equal to, or different than, c1), where two other emitters of antenna 330 are variously offset by distances a2, a3.

Due to variation between the respective total number of emitters for antennae 310, 320, 330 (and/or due to variation between the respective distributions of such emitters) antenna array 300 may provide for a different phase differentials each between two signals—e.g., wherein a phase differential changes along the length of antennae as said signals variously propagate each in a respective one of antennae 310, 320, 330. For example, an amount of a phase differential for signals at inputs 316, 326 (e.g., the amount being zero) may be different than an amount of a phase differential for such signals at respective corresponding emitters of antennae 310, 320.

Figure 4:
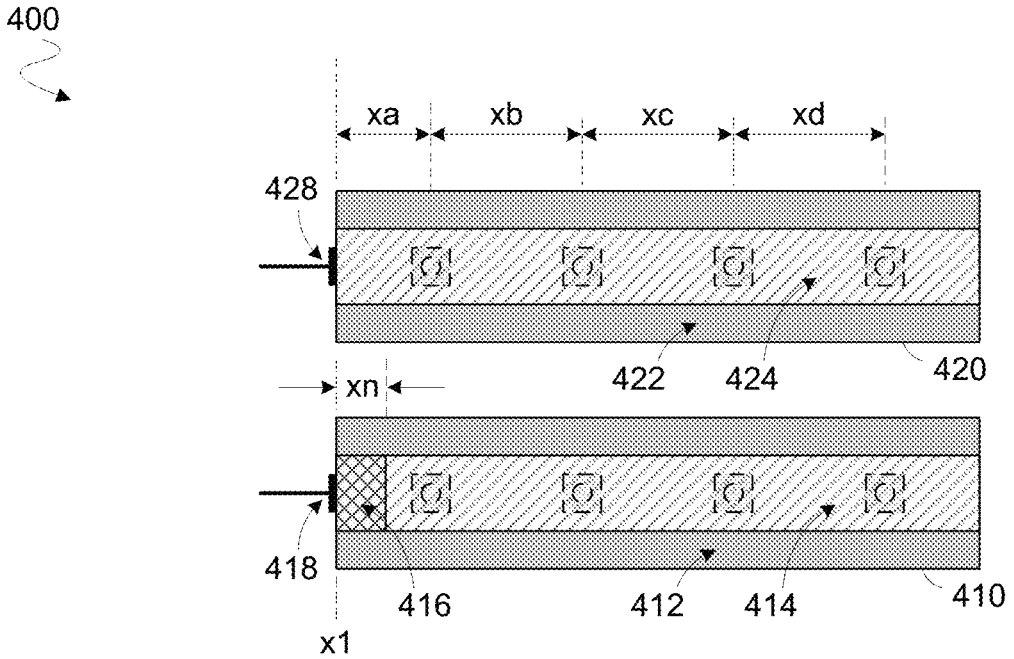
FIG. 4 shows cross-sectional views of respective antenna arrays each to transmit a signal according to a corresponding embodiment.
Figure 4:
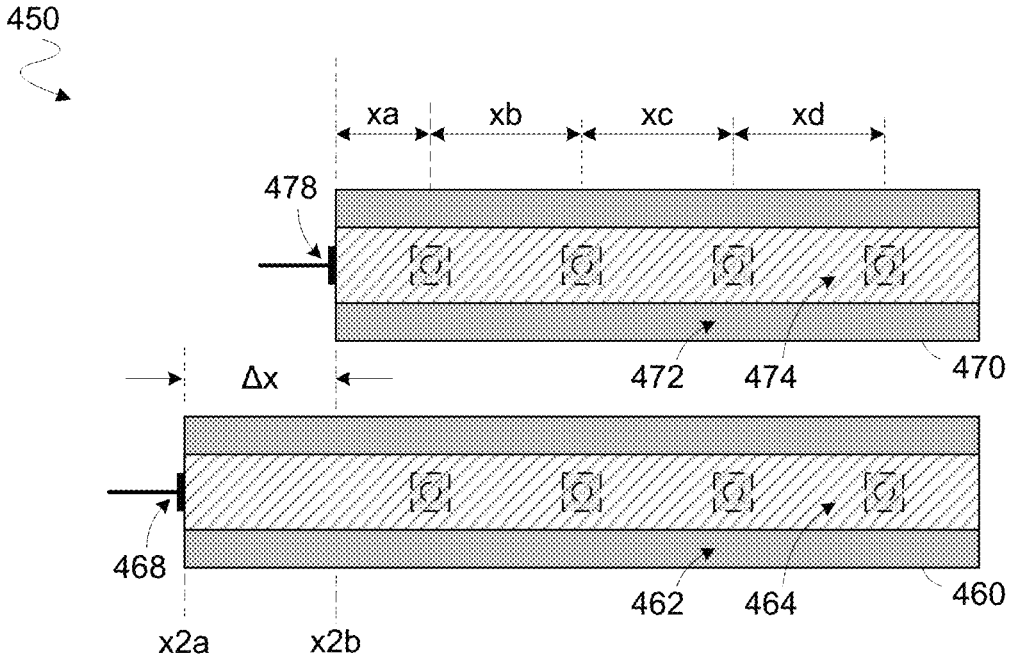

FIG. 4 shows cross-sectional top views of antenna arrays 400, 450 each to transmit signals according to a corresponding embodiment. One or each of antenna arrays 400, 450 may include features of antenna arrays 110, 300—e.g. where operation of antenna array 400 or antenna array 450 is performed according to method 200.

Antenna arrays 400, 450 illustrate embodiments that variously provide for change in signal phase differentials between two (or more) antennae, where the change is due in part to the propagation of signals, in respective antennae, through different dielectric structures. In the illustrative embodiment of array 400, respective inputs 418, 428 of antennae 410, 420 are coupled each to receive a respective signal. Inputs 418, 428 may be aligned with one another along a line x1 that, for example, is perpendicular to a direction of alignment of antennae 410, 420. Although certain embodiments are not limited in this regard, antennae 410, 420 may have the same number and arrangement of respective emitters. For example, offsets xa, xb, xc, xd from line x0 may variously define locations of the respective emitters of antennae 410, 420.

In an embodiment, a dielectric 424, disposed in a waveguide structure 422 of antenna 420, has a first permittivity and extends along the entire length of antenna 420. By contrast, a dielectric 414 and a dielectric 416, disposed in a waveguide structure 412 of antenna 410, may variously extend each only partially along the length of antenna 410, where one or each of dielectric 414 and dielectric 416 has a respective permittivity other than the first permittivity. Due to variation between the respective dielectric structures of antennae 410, 420, an amount of a phase difference for signals at respective ones of inputs 418, 428 may be different—e.g., less than—a phase difference for the same signals at respective ones of the emitters at offset xa (for example).

In the embodiment of array 450, an antenna 460 includes a waveguide structure 462 and a dielectric material 464 disposed therein, wherein dielectric material 464 extends the entire length of antenna 460. Additionally or alternatively, an antenna 470 of array 450 may include a waveguide structure 472 and a dielectric material 474 disposed therein, wherein dielectric material 474 extends the entire length of antenna 470. A permittivity of dielectric material 464 may be equal to that of dielectric material 474.

Inputs 468, 478 of antennae 460, 470 may be variously coupled each to receive a respective signal. Respective emitters of antennae 460, 470 may have the same total number and may have the same arrangement relative to one another—e.g., where offsets xa, xb, xc, xd variously define distances between pairs of such emitters. However, inputs 468, 478 may be offset by different respective distances each from a respective closest emitter. For example, inputs 468, 478 may be aligned with respective lines x2*a*, x2*b* that are offset from one another by a distance Δx. Whereas offset xa separates input 478 from a closest emitter of antenna 470, a greater distance (Δx+xa) separates input 468 from a closest emitter of antenna 460. Due to variation between the respective dielectric structures of antennae 460, 470, an amount of a phase difference for signals at respective ones of inputs 468, 478 may be different—e.g., less than—a phase difference for the same signals at the respective Nth emitters closest to inputs 468, 478.

Figure 5:
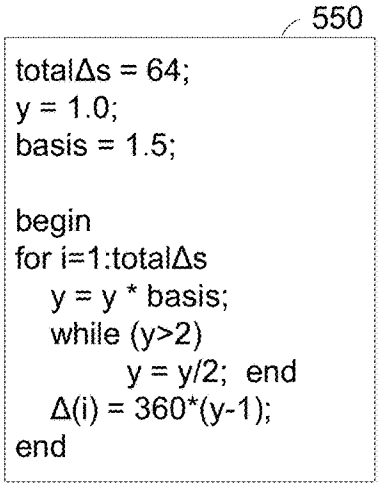
FIG. 5 is a flow diagram illustrating elements of a method to determine phase differential information according to an embodiment.
Figure 5:
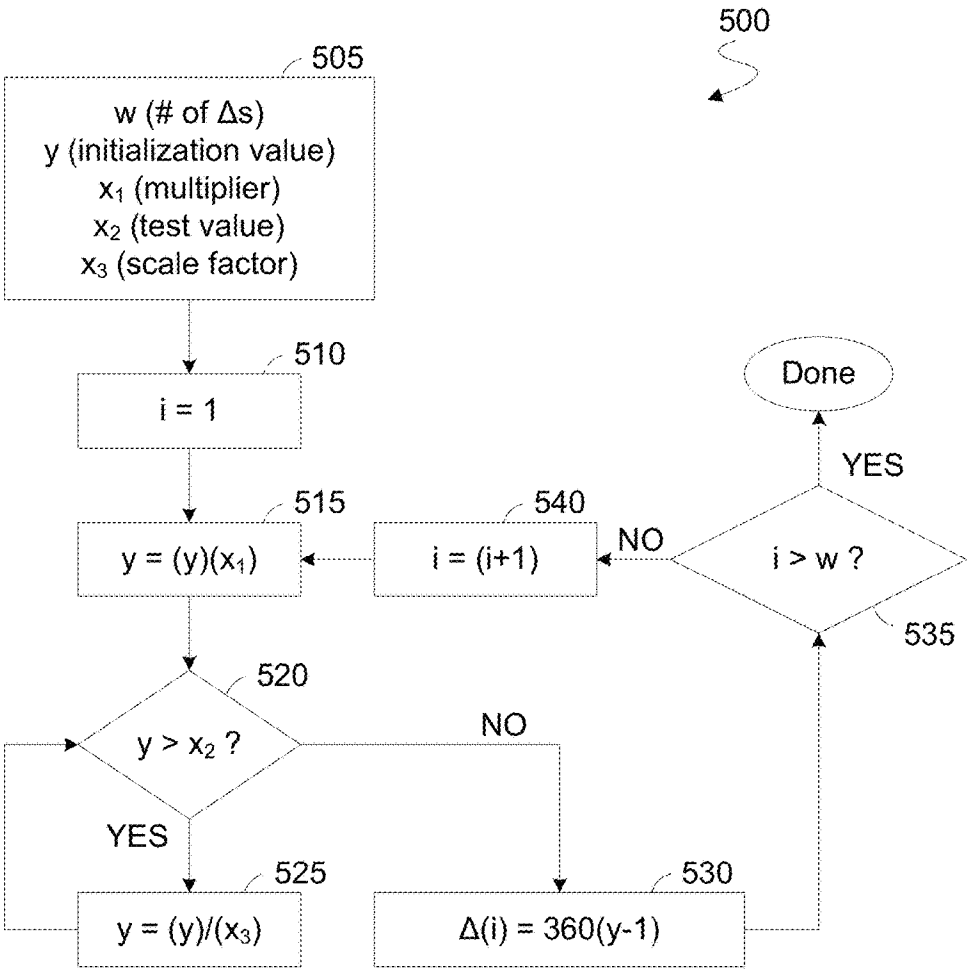

FIG. 5 illustrates elements of a method 500 for determining, according to an embodiment, a set of differences—each between a respective pair of phase differentials—to be provided with an antenna array. Design of an antenna array with method 500 may mitigate constructive interference between side lobes from different respective pairs of antennae in the array. Such an array may include one of arrays 110, 300, 400, 450, for example.

Method 500 may comprise, at 505, setting respective values for variables and constants used to determine a set of difference values. In the illustrative embodiment shown, values w and y represent, respectively, a total number of difference values (Δs) to be determined by method 500, and a phase difference variable. Values $x_1$, $x_2$, $x_3$ are constant values to be used in recursive processing with the value y.

At 510 of method 500, a counter value i may be set to an initial value (e.g., 1), where i represents a count of the current loop of method 500 (e.g., the loop to be not more than the value of w). At 515, the value y is multiplied by $x_1$, and an evaluation is made at 515 as to whether the resulting value of y is greater than $x_2$. The value of y may be divided at 525 by scale factor $x_3$—one or more times, as necessary—until y is less than (or equal to) $x_2$. In response to the value of y being less than (or equal to) $x_2$, method 500 may, at 530, set a value for the ith difference Δ(i)—e.g., by setting Δ(i) equal to 360(y−1). If it is determined at 535 that additional difference values are to be calculated, method 500 may increment the counter value i, at 540, and return to another multiplication of y by $x_1$, at 515. Otherwise, method 500 may finish if all difference values have been calculated.

Method 500 may enable mitigation of constructive interference between signals variously emitted by an antenna array. For example, method 500 may generate a set of difference values, where, for a given difference value, none of the difference values is an integer multiple of that difference value. This may aid in the set of phase difference characteristics providing a pseudo-random distribution of differences between phase differentials.

FIG. 5 further shows pseudocode 550 for one implementation of method 500 according to an embodiment. In the example of pseudocode 550, the constant total Δs corresponds to the value w, and the constant basis corresponds to the value $x_1$. Furthermore, y is equal to 1, and $x_2$ and $x_3$ are both equal to 2. The example embodiment of pseudocode 550 represents a corollary to a modified version of the Circle of Fifths distribution of musical notes.

Method 500 is one example of an algorithm to generate a set of difference values wherein, for each difference value of the set, the difference value corresponds to (e.g., is based on) a respective quotient of a respective first value and a second value ($x_3$) raised to a first respective power. The respective first value is equal to a product of a third value (y) and a fourth value ($x_1$) raised to a second respective power. Based on the values—e.g., where $x_3$ is not an even integer multiple of $x_1$—such a set of difference values may provide for a pseudo-random distribution of phase differentials in the 0° to 360° (0 to 2π radian) range.

Figure 6A:
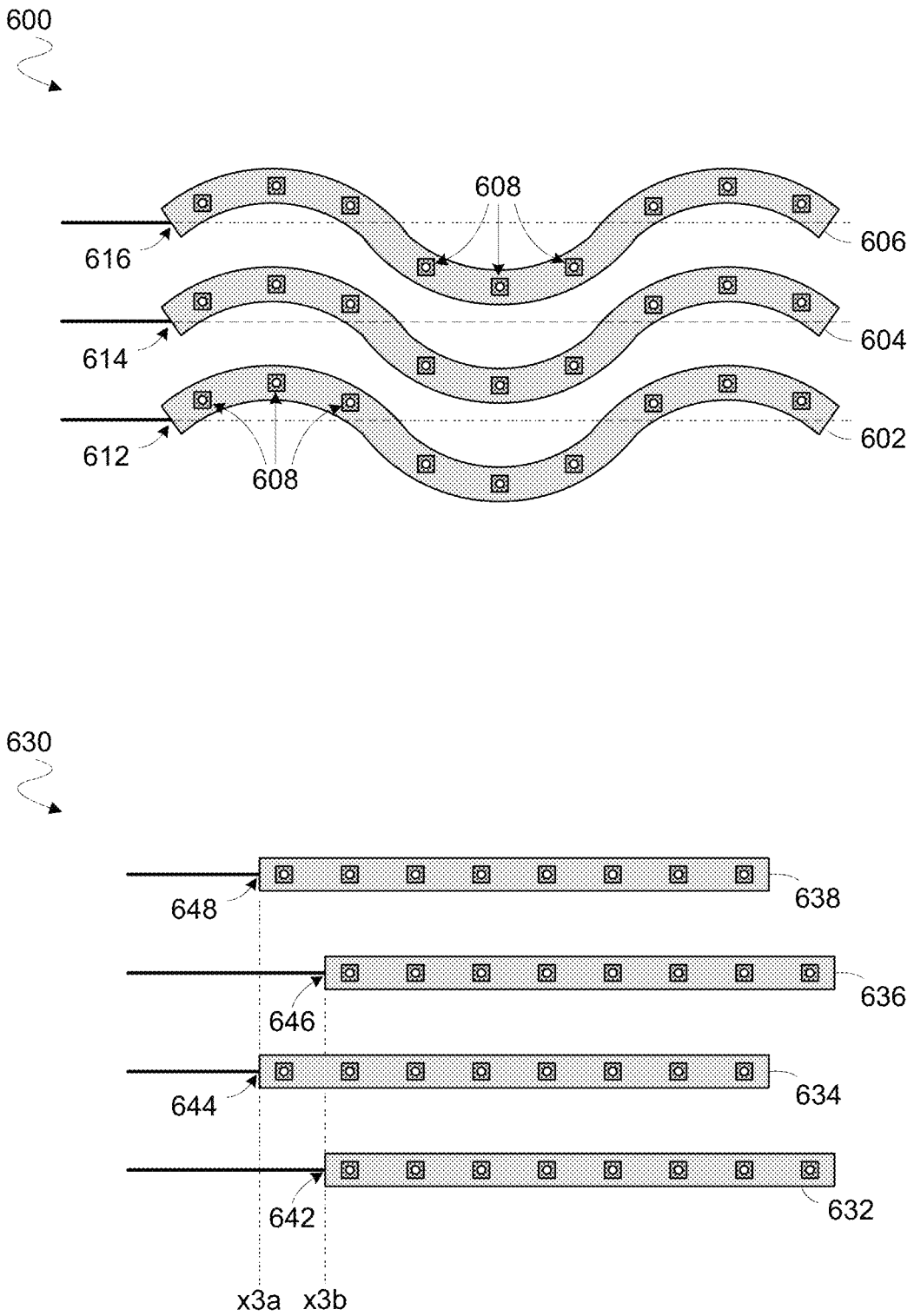
FIG. 6A shows top views of respective antenna arrays each to transmit a signal according to a corresponding embodiment.

FIG. 6A shows top views of antenna arrays 600, 630 to variously transmit respective signals each according to a corresponding embodiment. Antenna arrays 600, 630 may variously include features such as those of antenna array 110 or any of various other arrays described herein—e.g. where operation of antenna array 600 and/or antenna array 630 is performed according to method 200.

In an embodiment, system 600 includes antennae 602, 604, 606, where respective inputs 612, 614, 616 of antennae 602, 604, 606 are coupled each to receive a respective signal. Different respective configurations of antennae 602, 604, 606 may provide for changes in phase differentials between such signals. Such changes may be provided by different dielectric structures in antennae 602, 604, 606, different respective arrangements of emitters 608 in array 600 and/or the like. In one embodiment, constructive interference may be further mitigated by one or more curved shapes of antennae 602, 604, 606. Such curved shapes may break up a symmetry and/or alignment between different emitted signals that might otherwise contribute to the size of side lobes.

In another embodiment, system 630 includes antennae 632, 634, 636, 638, where respective inputs 642, 644, 646, 648 of antennae 632, 634, 636, 638 are coupled each to receive a respective signal. Similar to array 600, for example, different respective configurations of antennae 632, 634, 636, 638 may provide for changes in phase differentials between signals. In one embodiment, side lobe elements may be further mitigated by variously offsetting inputs 642, 644, 646, 648 from one another along a direction of alignment for antennae 632, 634, 636, 638. For example, inputs 642, 644, 646, 648 may be variously located at different positions—e.g., on alternate ones of lines x3*a*, x3*b*. Such linear offsetting of antennae 632, 634, 636, 638 may aid in avoiding regions of constructive interference along the sides of array 630. Any of a variety of additional or alternative positions of fewer antenna inputs or more antenna inputs may be provided, according to different embodiments.

Figure 6B:
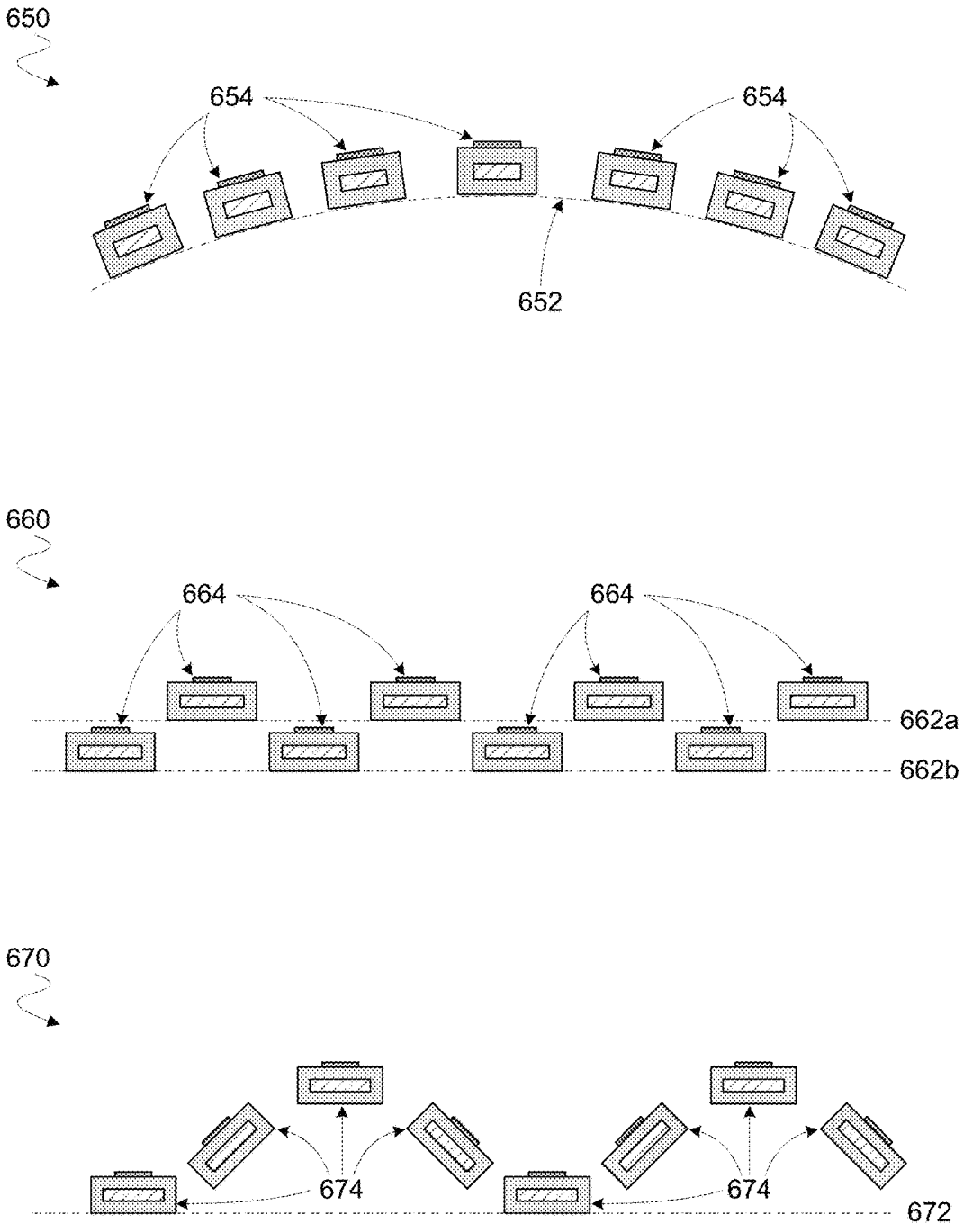
FIG. 6B shows cross-sectional views of respective antenna arrays each to transmit a signal according to a corresponding embodiment.

FIG. 6B shows cross-sectional end views of antenna arrays 650, 660, 670 to transmit respective signals each according to a corresponding embodiment. Antenna arrays 650, 660, 670 may variously include features such as those of antenna array 110, for example. In an embodiment, some or all of antenna arrays 650, 660, 670 may be variously operated according to method 200.

In an embodiment, array 650 includes antennae 654, the respective bottom sides of which are variously positioned along a curved arc 652. Different respective configurations of antennae 654—e.g., including different dielectric structures, different respective numbers of emitters and/or positions of emitters, etc.—may provide for different phase differentials between signals variously propagated in antennae 654. Positioning of antennae 654 along curved arc 652 may further reduce the possibility of areas where signals emitted by array 650 constructively interfere with one another.

In another embodiment, array 660 includes antennae 664, the respective bottom sides of which are parallel to one another, but which are variously positioned each on a respective one of flat planes 662*a*, 662*b*. Different respective configurations of antennae 664 may passively induce changes in phase differentials, as discussed herein. The various positioning of antennae 664 on respective ones of flat planes 662*a*, 662*b* may aid in breaking up regions of constructive interference near array 660. Any of a variety of additional or alternative positions of antennas along respective flat planes and/or curved planes may be provided, according to different embodiments.

In another embodiment, array 670 includes antennae 674 which have different respective orientations and elevations with respect to a flat plane 672. In addition to changes in phase differentials that might be induced passively by antennae 674, the different respective elevations and orientations of antennae 674 may further reduce the possibility of constructive interfere for signals emitted by array 670.

Figure 7:
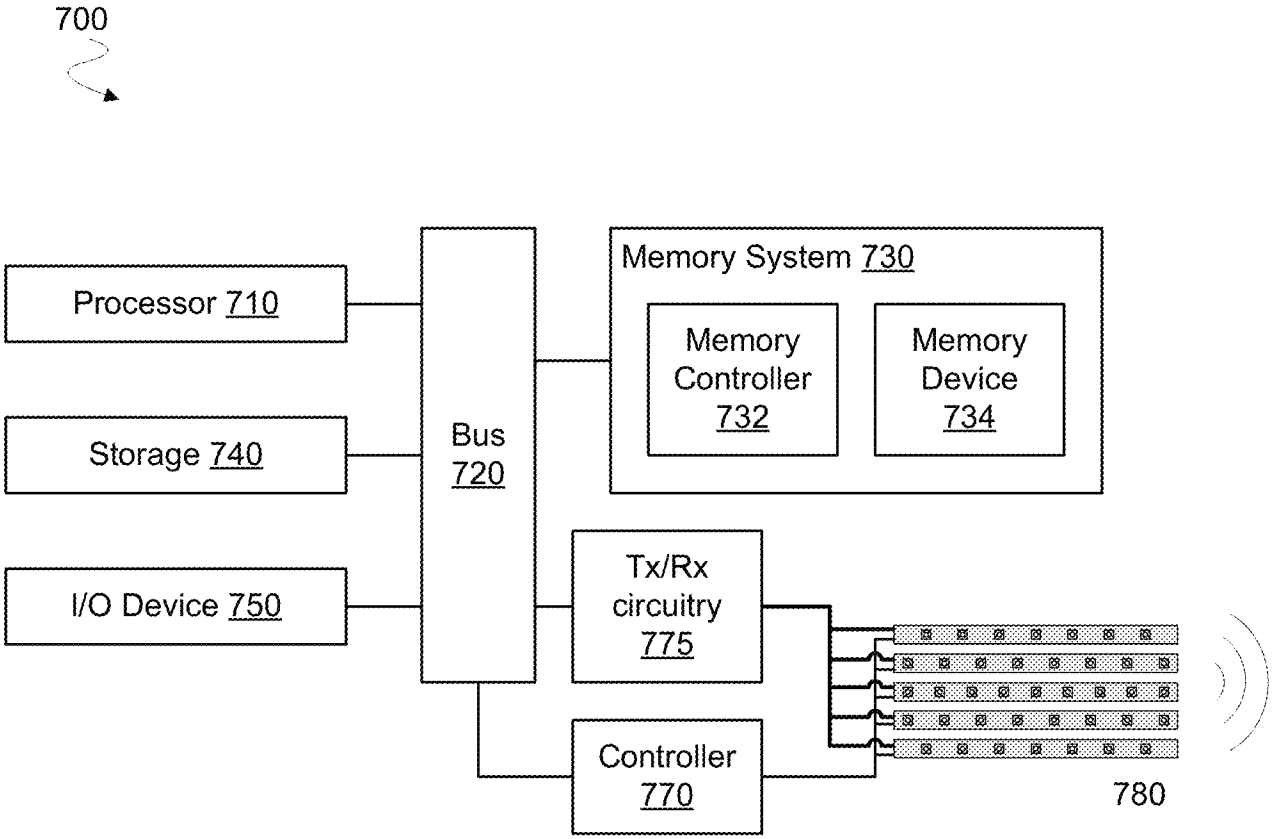
FIG. 7 is a functional block diagram illustrating elements of a platform to operate an antenna array according to an embodiment.

FIG. 7 illustrates elements of a platform 700 including an antenna array 780 according to an embodiment. Platform 700 may comprise a hardware platform of a desktop computer, laptop computer, handheld device (e.g., smart phone, palmtop computer, etc.) game console or other such system. Antenna array 780 may include a plurality of antennae having features variously discussed herein. Transmit circuitry such as the illustrative Tx/Rx circuitry 775 of platform 700 (which, in some embodiments, further comprises receive circuitry), may comprise circuitry coupled to operate as a signal source for antenna array 780. A controller 770 may include circuitry to exchange control signals with antenna array 780—e.g., where emitters of the plurality of antennae are variously operated by controller 770 in response to such a signal exchange. Tuning and/or operation of antenna array 780 may include operations adapted from conventional emitter control/signaling techniques, which are not detailed herein and are not limiting on certain embodiments.

In an embodiment, antenna array 780 serves as an antenna or other mechanism to facilitate communication on behalf of a host of platform 700. By way of illustration and not limitation, such a host may include one or more processors, such as the illustrative processor 710. One or more interconnects, as represented by the illustrative bus 720, may couple processor 710 to controller 770, Tx/Rx circuitry 775 and/or one or more components of platform 700.

In an embodiment, such one or more components may include a memory system 730 comprising a memory controller 732 and a memory device 734 (e.g., a dynamic random access memory). Memory device 734 may store instructions, data and/or other information that, for example, support execution of an operating system or other software by processor 710. A storage 740 of platform 700—e.g., including a hard disk drive and/or a solid state drive—may provide non-volatile storage of data to be made available to processor 710. In an embodiment, one or more input/output (I/O) devices 750—e.g., including a touchscreen, touchpad, keyboard, speaker, network interface and/or the like—may support exchanges to and/or from the platform 700 that are based on and/or determine signal exchanges via antenna array 780.

Techniques and architectures for transmitting electromagnetic signals are described herein. In the above description, for purposes of explanation, numerous specific details are set forth in order to provide a thorough understanding of certain embodiments. It will be apparent, however, to one skilled in the art that certain embodiments can be practiced without these specific details. In other instances, structures and devices are shown in block diagram form in order to avoid obscuring the description.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Some portions of the detailed description herein are presented in terms of algorithms and symbolic representations of operations on data bits within a computer memory. These algorithmic descriptions and representations are the means used by those skilled in the computing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the discussion herein, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Certain embodiments also relate to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs) such as dynamic RAM (DRAM), EPROMs, EEPROMs, magnetic or optical cards, or any type of media suitable for storing electronic instructions, and coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description herein. In addition, certain embodiments are not described with reference to any particular programming language. It will be appreciated that a variety of programming languages may be used to implement the teachings of such embodiments as described herein.

Besides what is described herein, various modifications may be made to the disclosed embodiments and implementations thereof without departing from their scope. Therefore, the illustrations and examples herein should be construed in an illustrative, and not a restrictive sense. The scope of the invention should be measured solely by reference to the claims that follow.

What is claimed is:

1. An antenna array comprising:

at least three antennae that each emit a same main beam energy so that respective main beams of the channels sum across the antenna array, the at least three antennae including a first antenna and a second antenna, the first antenna having a first waveguide with a first input configured to receive a first signal at a first time, the first antenna further including a first plurality of emitters including a first emitter, the first waveguide to propagate the first signal at the first emitter, wherein, of all emitters of the first plurality of emitters, the first emitter is an Nth closest emitter to the first input, wherein N is a positive integer; and the second antenna having a second waveguide with a second input configured to receive a second signal at the first time, the second antenna further including a second plurality of emitters including a second emitter, the second antenna to propagate the second signal at the second emitter, wherein, of all emitters of the second plurality of emitters, the second emitter is an Nth closest emitter to the second input;

wherein a first phase difference between the first signal when at the first input and the second signal when at the second input is different from a second phase difference between the first signal when at the first emitter and the second signal when at the second emitter, wherein a difference between the first and second phase differences is to mitigate side lobes created by the first and second antenna, wherein the first antenna comprises a first medium disposed between the first input and the first emitter, the first waveguide further to propagate the first signal from the first input to the first emitter via the first medium;

wherein the first antenna comprises a first medium disposed in the first waveguide between the first input and the first emitter, the first waveguide further to propagate the first signal from the first input to the first emitter via the first medium; and wherein the second antenna comprises second and third mediums disposed in the second waveguide between the second input and the second emitter, the second waveguide further to propagate the second signal from the second input to the second emitter via the second and third mediums; and a difference between the first phase difference and the second phase difference between the first and second signals when at the first and second sets of emitters being based at least in part on a difference between a permittivity of the first medium and a permittivity of one or both of the second and third mediums, respectively, that mitigates side lobes created by the first and second antenna, and wherein, for each pair of antennae of the at least three antennae, the pair of antennae provides a different respective one of a set of differences each between a respective pair of signal phase differences so that no two phase differences are integer multiples of each other.

2. The antenna array of claim 1, wherein the difference between the first phase difference and the second phase difference is due to at least in part a first difference between:

a distance of the first emitter from the first input; and a distance of the second emitter from the second input.

3. The antenna array of claim 2, wherein the first difference is equal to or greater than a width of the first emitter.

4. The antenna array of claim 1, wherein the first medium adjoins the first input and further adjoins the first emitter.

5. The antenna array of claim 1, wherein the first medium extends only partially along a path from the first input to the first emitter.

6. The antenna array of claim 1, wherein inputs of the antenna array include inputs disposed along a straight line and one or more inputs offset from the straight line.

7. The antenna array of claim 1, wherein the antenna array includes multiple antennae having different respective orientations relative to a plane.

8. The antenna array of claim 1, wherein the first antenna is curved.

9. A system comprising:

an antenna array comprising: at least three antennae that each emit a same main beam energy so that respective main beams of the channels sum across the antenna array, the at least three antennae including a first antenna and a second antenna, the first antenna having a first waveguide with a first input configured to receive a first signal at a first time, the first antenna further including a first plurality of emitters including a first emitter, the first waveguide to propagate the first signal at the first emitter, wherein, of all emitters of the first plurality of emitters, the first emitter is an Nth closest emitter to the first input, wherein N is a positive integer; and the second antenna having a second waveguide with a second input configured to receive a second signal at the first time, the second antenna further including a second plurality of emitters including a second emitter, the second antenna to propagate the second signal at the second emitter, wherein, of all emitters of the second plurality of emitters, the second emitter is an Nth closest emitter to the second input;

wherein a first phase difference between the first signal when at the first input and the second signal when at the second input is different from a second phase difference between the first signal when at the first emitter and the second signal when at the second emitter, wherein a difference between the first and second phase differences is to mitigate side lobes created by the first and second antenna; and a splitter coupled to the first antenna, the splitter comprising circuitry configured to split a third signal into a plurality of signals including the first signal and the second signal;

wherein the first antenna comprises a first medium disposed in the first waveguide between the first input and the first emitter, the first waveguide further to propagate the first signal from the first input to the first emitter via the first medium; and wherein the second antenna comprises second and third mediums disposed in the second waveguide between the second input and the second emitter, the second waveguide further to propagate the second signal from the second input to the second emitter via the second and third mediums; and a difference between the first phase difference and the second phase difference between the first and second signals when at the first and second sets of emitters being based at least in part on a difference between a permittivity of the first medium and a permittivity of one or both of the second and third mediums, respectively, that mitigates side lobes created by the first and second antenna, and wherein, for each pair of antennae of the at least three antennae, the pair of antennae provides a different respective one of a set of differences each between a respective pair of signal phase differences so that no two phase differences are integer multiples of each other.

10. The system of claim 9, wherein the difference between the first phase difference and the second phase difference is due to at least in part a first difference between:

a distance of the first emitter from the first input; and a distance of the second emitter from the second input.

11. A method at an antenna array, the method comprising:

receiving, at a first time, a first signal at a first input of a first antenna of at least three antennae that each emit a same main beam energy so that respective main beams of the channels sum across the antenna array;

receiving, at the first time, a second signal at a second input of a second antenna of the at least three antennae;

propagating the first signal through a first waveguide of the first antenna to first plurality of emitters including a first emitter of the first plurality of emitters, wherein, of all emitters of the first antenna, the first emitter is an Nth closest emitter to the first input, wherein N is a positive integer; and propagating the second signal through a second waveguide of the second antenna to second plurality of emitters including a second emitter of the second antenna, wherein, of all emitters of the second plurality of emitters, the second emitter is an Nth closest emitter to the second input, wherein a first phase difference between the first signal when at the first input and the second signal when at the second input is different from a second phase difference-between the first signal when at the first emitter and the second signal when at the second emitter, wherein difference between the first and second phase differences being to mitigate side lobes created by the first and second antenna, wherein the first waveguide comprises a first medium disposed in the first waveguide between the first input and the first emitter, the method further comprising propagating the first signal from the first input to the first emitter via the first medium;

wherein the second waveguide comprises second and third mediums disposed in the second waveguide between the second input and the second emitter, the second waveguide further to propagate the second signal from the second input to the second emitter via the second and third mediums; and wherein a difference between the first phase difference and the second phase difference between the first and second signals when at the first and second sets of emitters being based at least in part on a difference between a permittivity of the first medium and a permittivity of one or both of the second and third mediums, respectively, that mitigates side lobes created by the first and second antenna, and wherein, for each pair of antennae of the at least three antennae, the pair of antennae provides a different respective one of a set of differences each between a respective pair of signal phase differences so that no two phase differences are integer multiples of each other.

12. The method of claim 11, wherein the difference between the first phase difference and the second phase difference is due to at least in part a first difference between:

a distance of the first emitter from the first input; and a distance of the second emitter from the second input.

13. The method of claim 12, wherein the first medium extends only partially along a path from the first input to the first emitter.

14. The method of claim 11, further comprising propagating the first signal along a curved path in the first waveguide of the first antenna.

* * * * *